US008110976B2

(12) United States Patent
Kim et al.

(10) Patent No.: US 8,110,976 B2
(45) Date of Patent: Feb. 7, 2012

(54) METHOD OF PREPARING FIELD ELECTRON EMITTER AND FIELD ELECTRON EMISSION DEVICE INCLUDING FIELD ELECTRON EMITTER PREPARED BY THE METHOD

(75) Inventors: Yong-chul Kim, Seoul (KR); Byeong-kwon Ju, Seoul (KR); Seung-wook Kim, Seoul (KR)

(73) Assignees: Samsung Electronics Co., Ltd. (KR); Korea University Research and Business Foundation (KR)

( * ) Notice: Subject to any disclaimer, the term of this patent is extended or adjusted under 35 U.S.C. 154(b) by 212 days.

(21) Appl. No.: 12/499,604

(22) Filed: Jul. 8, 2009

(65) Prior Publication Data

US 2010/0007266 A1 Jan. 14, 2010

(30) Foreign Application Priority Data

Jul. 9, 2008 (KR) ..... 10-2008-0066734
Feb. 11, 2009 (KR) ..... 10-2009-0011217

(51) Int. Cl.
*H01J 9/00* (2006.01)
*H01J 1/62* (2006.01)
*H01J 63/04* (2006.01)

(52) U.S. Cl. ..... 313/496; 313/483; 313/495; 313/497; 445/1; 445/24; 445/25

(58) Field of Classification Search ..... None
See application file for complete search history.

(56) References Cited

U.S. PATENT DOCUMENTS

| | | | | |
|---|---|---|---|---|
| 7,374,649 | B2 * | 5/2008 | Jagota et al. | 204/456 |
| 2005/0009039 | A1 * | 1/2005 | Jagota et al. | 435/6 |
| 2009/0314647 | A1 * | 12/2009 | Zheng et al. | 205/50 |
| 2010/0181894 | A1 * | 7/2010 | Son et al. | 313/310 |

* cited by examiner

*Primary Examiner* — Natalie Walford
(74) *Attorney, Agent, or Firm* — Cantor Colburn LLP

(57) ABSTRACT

A method of preparing a field electron emitter includes preparing an aqueous solution including a carbon nanotube-nucleic acid composite, preparing a substrate to receive the carbon nanotube-nucleic acid composite, and electrophoresis-depositing the carbon nanotube-nucleic acid composite onto the substrate.

14 Claims, 5 Drawing Sheets

METHOD OF PREPARING FIELD ELECTRON EMITTER AND FIELD ELECTRON EMISSION DEVICE INCLUDING FIELD ELECTRON EMITTER PREPARED BY THE METHOD

CROSS-REFERENCE TO RELATED APPLICATIONS

This application claims priority to Korean Patent Application Nos. 10-2008-0066734, filed on 9 Jul. 2008, and 10-2009-0011217, filed on Feb. 11, 2009, and all the benefits accruing therefrom under 35 U.S.C. §119, the contents of which in their entireties are herein incorporated by reference.

BACKGROUND

1) Field

The general inventive concept relates to a method of preparing a field electron emitter and, more particularly, to a method of preparing a carbon nanotube field electron emitter and a field electron emission device including a carbon nanotube field electron emitter prepared by the method.

2) Description of the Related Art

In general, in electron emission devices, electrons are emitted from a field electron emitter in a cathode electrode by an electric field generated when a voltage is applied between the cathode electrode and an anode electrode. The electrons collide with a phosphor material on the anode electrode, and light is thereby emitted.

Since carbon nanotubes ("CNTs") exhibit excellent conductivity, excellent field concentration and emission properties and a low work function, as compared to other nanotubes, CNTs are more easily driven at a low voltage and are more easily manufactured to have a large area. Thus, CNTs are being increasingly utilized as field electron emitters.

CNTs generally include materials having cylindrical carbon molecules in which three carbon atoms are bonded to a fourth carbon atom in a hexagonal honeycomb shape. A typical carbon nanotube may have a diameter of several nanometers and a length of up to several millimeters. CNTs include a chemical bond having sp2 bonds, similar to those of graphite, and a hexagonal lattice of carbon atoms, e.g., a graphite layer. CNTs are categorized as either single walled carbon nanotubes ("SWCNTs") or multi-walled carbon nanotubes ("MWCNTs"), based on whether a number of graphite layers of the particular CNTs is singular or plural, respectively. When SWCNTs are formed in a shape such as that of a bundle, SWCNTs are further referred to as bundle-type SWCNTs. Furthermore, CNTs, whether SWCNTs or MWCNTs, may have properties of electrical conductors and/or semiconductors, based on a structure of the graphite layers.

In addition, CNTs have large specific surface area, high conductivity, uniform distribution of pores, high mechanical strength and stable chemical properties, as compared to other types of field electron emitters.

Methods of preparing field electron emitters for emitters in field effect electron emission devices and, more specifically, methods of preparing field electron emitters containing CNTs include a carbon nanotube growing method using a chemical vapor deposition ("CVD") method, a paste method using a composition for forming field electron emitters that contain CNTs and an electrophoretic deposition method, for example. When CNTs are deposited on a substrate in the electrophoretic deposition method, the CNTs are electrophoretic-deposited on the substrate while being dispersed in an organic solvent such as acetone, ethanol, dimethylformamide ("DMF") or benzene, for example. When the organic solvent is used in the electrophoretic-deposition method, a material not dissolved in the organic solvent, such as an inorganic material for example, forms a device structure on the substrate. In addition, a high voltage is applied in the electrophoretic deposition method, and it is therefore difficult to form a uniform field electron emitter.

SUMMARY

Exemplary embodiments of the present invention include a method of efficiently preparing, e.g., efficiently manufacturing, a carbon nanotube field electron emitter in an aqueous solution.

Exemplary embodiments of the present invention also include a field electron emission device including a field electron emitter prepared using the method and including substantially improved electron emission properties.

According to an exemplary embodiment, a method of preparing a carbon nanotube field electron emitter includes preparing an aqueous solution including a carbon nanotube-nucleic acid composite, preparing a substrate to receive the carbon nanotube-nucleic acid composite, and electrophoresis-depositing the carbon nanotube-nucleic acid composite onto the substrate.

According to an alternative exemplary embodiment, a field electron emission device includes a first substrate, a cathode disposed on the first substrate, a carbon nanotube field electron emitter disposed on the first substrate and electrically connected to the cathode, a second substrate facing the first substrate, an anode disposed on the second substrate, and a phosphor layer disposed on the second substrate and which emits light using electrons emitted from the carbon nanotube field electron emitter. The carbon nanotube field electron emitter is prepared by preparing an aqueous solution comprising a carbon nanotube-nucleic acid composite, and electrophoresis-depositing the carbon nanotube-nucleic acid composite onto the first substrate.

BRIEF DESCRIPTION OF THE DRAWINGS

The above and/or other aspects, features and advantages of the present invention will become more readily apparent by describing in further detail exemplary embodiments thereof with reference to the accompanying drawings, in which.

DETAILED DESCRIPTION

Figure 1:
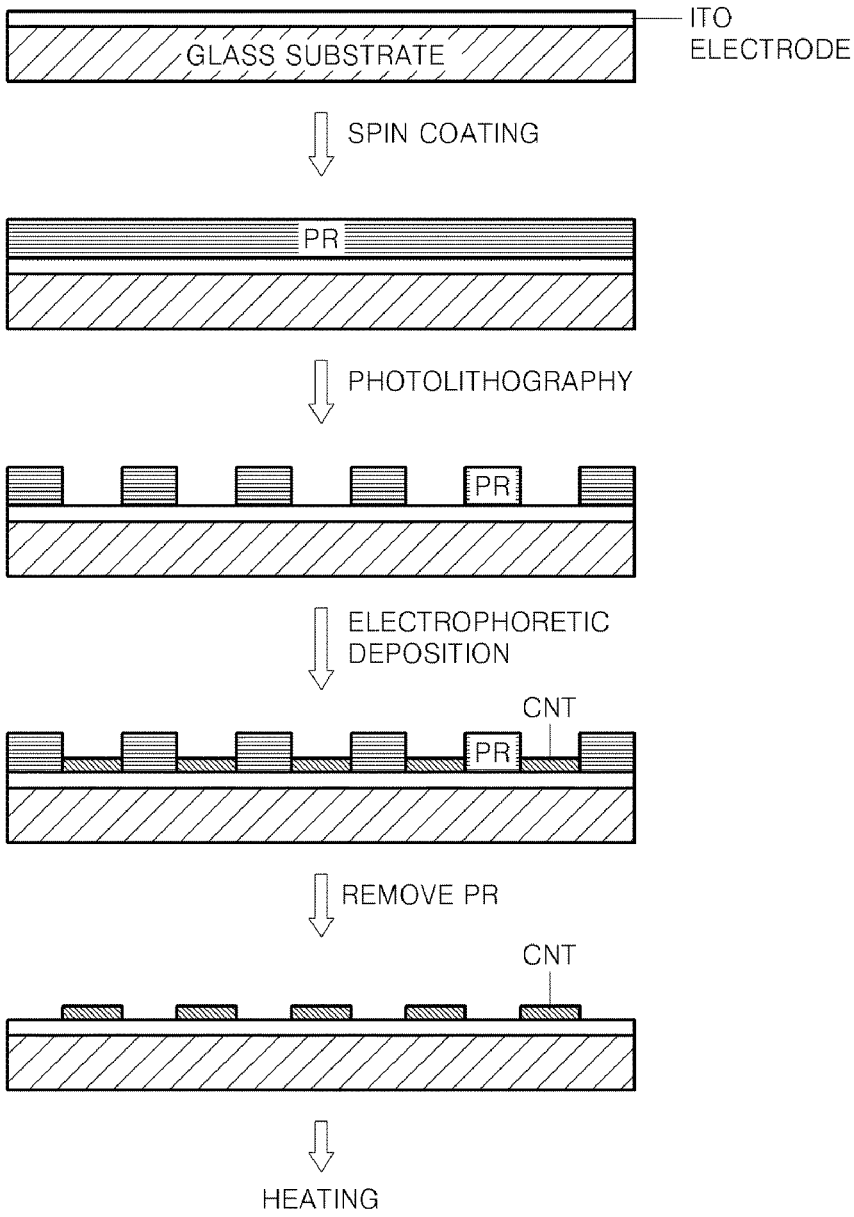
FIG. 1 is a set of partial cross-sectional views illustrating an exemplary embodiment of a method of preparing a carbon nanotube field electron emitter according to the present invention.

The invention now will be described more fully hereinafter with reference to the accompanying drawings, in which various embodiments are shown. This invention may, however, be embodied in many different forms, and should not be construed as limited to the embodiments set forth herein. Rather, these embodiments are provided so that this disclosure will be thorough and complete, and will fully convey the scope of the invention to those skilled in the art. Like reference numerals refer to like elements throughout.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

It will be understood that, although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting. As used herein, the singular forms "a," "an" and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower," can therefore, encompasses both an orientation of "lower" and "upper," depending on the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments are described herein with reference to cross section illustrations that are schematic illustrations of idealized embodiments. As such, variations from the shapes of the illustrations as a result, for example, of manufacturing techniques and/or tolerances, are to be expected. Thus, embodiments described herein should not be construed as limited to the particular shapes of regions as illustrated herein but are to include deviations in shapes that result, for example, from manufacturing. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims.

Hereinafter, exemplary embodiments will be described in further detail with reference to the accompanying drawings.

FIG. 1 is a set of partial cross-sectional views illustrating an exemplary embodiment of a method of preparing a carbon nanotube field electron emitter according to the present invention. Referring to FIG. 1, an ITO electrode is coated onto a glass substrate, photoresist PR is coated on the ITO electrode, the PR is patterned by using a photolithography method. In an exemplary embodiment, the photoresist PR is spin coated on to the ITO electrode. The photoresist PR is patterned by photolithography to form a patterned region on the ITO electrode on the glass substrate. A carbon nanotube ("CNT")-nucleic acid is deposited onto the patterned region by electrophoretic deposition, the photoresist PR is removed, and the glass substrate, the ITO electrode and the CNT-nucleic acid are heated. In addition, a carbon nanotube field electron emitter is activated by performing selective taping, as will be described in further detail below with reference to Example exemplary embodiments.

More specifically, and referring to FIG. 1, in an exemplary embodiment, a method of preparing a carbon nanotube field electron emitter includes: preparing an aqueous solution including a carbon nanotube-nucleic acid composite; preparing a substrate to receive the carbon nanotube-nucleic acid composite; and electrophoresis-depositing the carbon nanotube-nucleic acid composite onto the substrate.

A nucleic acid used in the carbon nanotube-nucleic acid composite may be deoxyribonucleic acid ("DNA"), ribonucleic acid ("RNA") or peptide nucleic acid ("PNA"), for example. In addition, the nucleic acid may be extracted from a natural nucleic acid source, or the nucleic acid may be synthesized or, alternatively, semi-synthesized. The nucleic acid may be a single-stranded nucleic acid or a double-stranded nucleic acid. In an exemplary embodiment, the nucleic acid is a single-stranded nucleic acid, and the nucleic acid may have a length less than a length of carbon nanotubes ("CNTs") in the carbon nanotube-nucleic acid composite. More specifically, for example, in an exemplary embodiment, a length of the nucleic acid is from about 50 to about 200 times less than a length of the CNTs. In addition, the nucleic acid may be transfer RNA ("tRNA"). Secondary or tertiary structures in nucleic acid molecules may be removed by heating the nucleic acid, for example. More particularly, the heating may be performed at a temperature varying based on the length and a nucleotide composition of the nucleic acid. For example, the heating may be performed at a temperature greater than a melting temperature ("Tm") of the nucleic acid.

As used herein, the melting temperature Tm is a temperature at which half of the nucleic acids in a solution are denatured, while the other half of the nucleic acids in the solution are not denatured. More specifically, for example, the heating in exemplary embodiments may performed at temperature equal or greater than: Tm+5 degrees Celsius (° C.); Tm+10° C.; Tm+15° C.; Tm+20° C.; Tm+25° C.; or Tm+30° C., but alternative exemplary embodiments are not limited thereto.

The CNTs in an exemplary embodiment may be one selected from a group consisting of single walled carbon nanotubes ("SWCNTs"), double walled carbon nanotubes ("DWCNTs"), multi-walled carbon nanotubes ("MWCNTs"), chemically-modified CNTs, metallic CNTs, semiconductor CNTs, metalized CNTs and any combinations thereof.

The aqueous solution including the carbon nanotube-nucleic acid composite may include water and/or a buffer used in an electrophoresis of the nucleic acid. The buffer may include, for example, a tris-acetic acid-ethylenediaminetetraacetic acid ("EDTA") ("TAE") buffer, a tris-boric acid-EDTA ("TBE") buffer and/or a phosphate buffered saline ("PBS") buffer. The TAE buffer may include tris with a concentration from about 4 millimolar (mM) to about 20 mM, acetic acid with a concentration from about 1.8 mM to about 9 mM, and EDTA with a concentration from about 1 mM to about 5 mM.

In an exemplary embodiment, the aqueous solution including the carbon nanotube-nucleic acid composite may be a dispersion solution of CNTs and the nucleic acid. Moreover, the aqueous solution including the carbon nanotube-nucleic acid composite may be prepared by mixing the CNTs and the nucleic acid in an aqueous solution. The preparing of the aqueous solution including the carbon nanotube-nucleic acid composite may include dispersing the CNTs and the nucleic acid in the aqueous solution. The dispersing of the CNTs and the nucleic acid may be performed by sonicating (e.g., applying sound waves to), and more specifically, for example, ultrasonicating the CNTs and the nucleic acid. In addition, a precipitation removal operation such as centrifugation, for example, may be performed on the dispersion solution of the CNTs and the nucleic acid. By performing the precipitation removing operation, a dispersion solution of the CNTs and the nucleic acid is made uniform. In the aqueous solution including the carbon nanotube-nucleic acid composite, the nucleic acid binds to the CNT by wrapping around the CNT. However, alternative exemplary embodiment embodiments are not limited to any specific or particular binding mechanism.

As used herein with reference to exemplary embodiments, terms "composite material," "hybrid" and "hybrid material" may be collectively referred to as "composite."

In an exemplary embodiment, the CNTs and the nucleic acid may be mixed in a ratio, based on weights of the CNTs and the nucleic acid, from about 1:1 to about 4:1.

As noted above, an exemplary embodiment of a method of preparing a carbon nanotube field electron emitter includes electrophoresis-depositing the carbon nanotube-nucleic acid composite onto the substrate.

More specifically, electrophoretic deposition includes moving colloid particles suspended in a liquid medium by an electric force to deposit the colloid particles on an electrode, e.g., depositing the CNTs on the substrate, for example.

In an exemplary embodiment, the substrate includes a conductive material. Accordingly, the substrate in an exemplary embodiment is an electrode. More specifically, for example, the substrate according to an exemplary embodiment may be a glass substrate including an indium-doped tin oxide ("ITO").

The electrophoretic deposition may be performed by applying an alternative current ("AC") voltage to a cathode and an anode while the cathode and the anode are immersed in the aqueous solution including the carbon nanotube-nucleic acid composite. Accordingly, the substrate acts as a cathode, and a platinum (Pt) electrode, for example, acts as an anode. When an interval between the anode and the cathode is from about 1 centimeter (cm) to about 2 cm, the AC voltage may be from about 5 volts (V) to about 40 V. More particularly, for example, the AC voltage in an exemplary embodiment is from about 5 V to about 15 V. In addition, a time for which the AC voltage is applied is regulated, and the time may be, for example, from about 3 minutes to about 5 minutes.

In an exemplary embodiment, the substrate may include a patterned photoresist layer. A photoresist of the patterned photoresist layer is a photosensitive material, and is used to form a patterned surface on the substrate by photolithography. More specifically, the photoresist includes a positive photoresist and a negative photoresist. Thus, when a first portion of the photoresist, e.g., the positive photoresist, is exposed to light, the first portion is soluble in a photoresist developer. In contrast, when a second portion of the photoresist, e.g., the negative photoresist, is exposed to light, the second portion is relatively insoluble in the photoresist developer. The photoresist according to an exemplary embodiment is an organic material. The photoresist may be, for example, a photoresist including a mixture of diazonaphthoquinone ("DNQ") and a phenol formaldehyde (e.g., Novolac) resin, or a photoresist including an epoxy-based polymer (e.g., SU-8 photoresist). In an exemplary embodiment, it is easier to selectively remove the photoresist from the substrate after performing the electrophoretic deposition, since the photoresist according to an exemplary embodiment is an organic material. More specifically, the photoresist may be removed from the substrate by peeling the photoresist or by using a solvent such as acetone and/or a photoresist stripper, for example.

According to an alternative exemplary embodiment, the method of preparing the carbon nanotube field electron emitter further includes electrophoresis-depositing the carbon nanotube-nucleic acid composite onto the patterned regions of the substrate, as well as removing the photoresist layer. Photolithography may be used as the patterning method, for example, to form the patterned regions. The photoresist layer may be removed by peeling the photoresist or using a solvent such as acetone and/or a photoresist stripper, for example. A shape and density of a particular pattern of each of the patterned regions may vary based on a density of CNTs deposited on the substrate. For example, patterned regions having a substantially circular or, alternatively, rectangular, shape may be arranged in an array. In this case, the array of the carbon nanotube field electron emitter is formed by depositing the carbon nanotube-nucleic acid composite onto the patterned regions. It will be noted that alternative exemplary embodiments are not limited to the foregoing description, and that the shape, size and/or arrangement, for example, of the array may be modified based on electron emission properties of the field electron emitter, for example.

In an alternative exemplary embodiment, the method of preparing the carbon nanotube field electron emitter further includes sintering the substrate on which the carbon nanotube-nucleic acid composite is deposited. The sintering may be performed at a temperature from about 200° C. to about 500° C. More specifically, in an exemplary embodiment, the sintering may be performed at a temperature from about 350° C. to about 400° C. A portion of the nucleic acid of the carbon nanotube-nucleic acid composite is removed from the substrate by the sintering.

In alternative exemplary embodiment, the method of preparing the carbon nanotube field electron emitter may include taping to activate the substrate on which the CNTs are deposited. More specifically, the taping is performed by attaching at least one selected from a group consisting of an adhesive tape, a liquid polymer and an elastic rubber onto the substrate and then detaching the same from the substrate. Thus, in an exemplary embodiment, in addition to activating the CNTs by performing the sintering, the CNTs are further activated by the taping.

The carbon nanotube field electron emitter prepared according to one or more of the exemplary embodiments of the methods described herein may be used in a field electron emission device, as will now be described in further detail.

In an exemplary embodiment as will be described in further detail below with reference to FIG. 2, a field electron emission device includes a first substrate, a cathode disposed on the first substrate, a carbon nanotube field electron emitter disposed on the first substrate and electrically connected to the cathode, a second substrate disposed opposite to, e.g., facing, the first substrate, an anode disposed on the second substrate, and a phosphor layer disposed on the second substrate. The phosphor layer is coated on the anode electrode and emits light using electrons emitted from the first substrate, e.g., from the carbon nanotube field electron emitter. The phosphor layer includes a phosphor material such as a blue phosphor, a green phosphor and/or a red phosphor, for example. More specifically, the blue phosphor may include, for example: $(Sr,Ba,Ca)_5(PO_4)_3Cl:Eu^{2+}$; $BaMg_2Al_{16}O_{27}:Eu^{2+}$; $Sr_4Al_{14}O_{25}:Eu^{2+}$; $BaAl_8O_{13}:Eu^{2+}$; $BaMgAl_{10}O_{17}:Eu^{2+}$ and $Sr_2Si_3O_8(2SrCl_2:Eu^{2+})$; and/or $Ba_3MgSi_2O_8:Eu^{2+}$ and $(Sr,Ca)_{10}(PO_4)_6(nB_2O_3:Eu^{2+})$. The green phosphor may include, for example: $(Ba,Sr,Ca)_2SiO_4:Eu^{2+}$; $Ba_2MgSi_2O_7:Eu^{2+}$; $Ba_2ZnSi_2O_7:Eu^{2+}$; $BaAl_2O_4:Eu^{2+}$; $SrAl_2O_4:Eu^{2+}$; $BaMgAl_{10}O_{17}:Eu^{2+}$, $Mn^{2+}$; and/or $BaMg_2Al_{16}O_{27}:Eu^{2+}$, $Mn^{2+}$. The red phosphor may include, for example: $(Ba,Sr,Ca)_2Si_5N_8:Eu^{2+}$; $(Sr,Ca)AlSiN_3:Eu^{2+}$; $Y_2O_3:Eu^{3+},Bi^{3+}$; $(Ca,Sr)S:Eu^{2+}$; $CaLa_2S_4:Ce^{3+}$; $(Sr,Ca,Ba)_2P_2O_7:Eu^{2+}$, $Mn^{2+}$; $(Ca,Sr)_{10}(PO_4)_6(F,Cl):Eu^{2+},Mn^{2+}$; $(Y,Lu)_2WO_6:Eu^{3+},Mo^{6+}$; $(Gd,Y,Lu,La)_2O_3:Eu^{3+},Bi^{3+}$; $(Gd,Y,Lu,La)_2O_2S:Eu^{3+},Bi^{3+}$; $(Gd,Y,Lu,La)BO_3:Eu^{3+}$, $Bi^{3+}$; $(Gd,Y,Lu,La)(P,V)O_4:Eu^{3+}$, $Bi^{3+}$; and/or $(Ba,Sr,Ca)MgP_2O_7:Eu^{2+},Mn^{2+}$.

Figure 2:
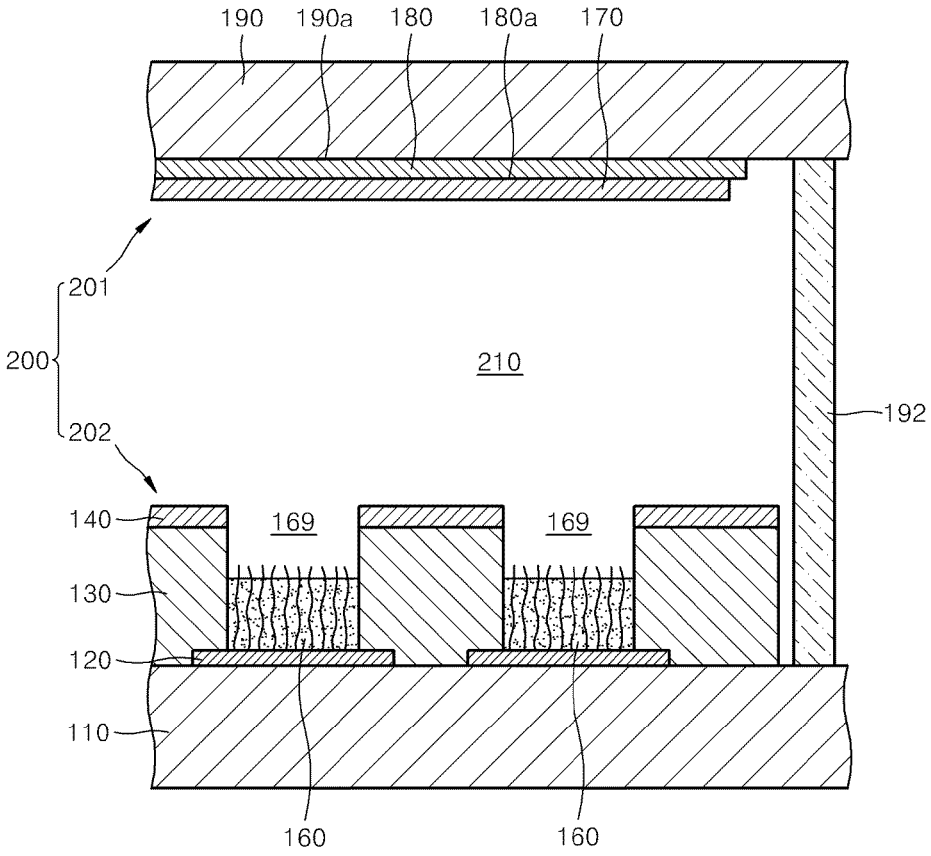
FIG. 2 is a partial cross-sectional view of an exemplary embodiment of a field electron emission device according to the present invention.

FIG. 2 is a partial cross-sectional view of an exemplary embodiment of a field electron emission device 200 according to an exemplary embodiment. The field electron emission device 200 shown in FIG. 2 is a triode-type electron emission device, but alternative exemplary embodiments are not limited thereto. Referring now to FIG. 2, the field electron emission device 200 according to an exemplary embodiment includes an upper plate 201 and a lower plate 202. The lower plate 202 includes a first substrate 110 (hereinafter referred to as a "lower substrate" 110), and the upper plate 201 includes a second substrate 190 (hereinafter referred to as an "upper substrate" 190).

The upper plate 201 includes the upper substrate 190, an anode 180 disposed on a lower surface 190*a* of the upper substrate 190, and a phosphor layer 170 disposed on a lower surface 180*a* of the anode 180.

Figure 5:
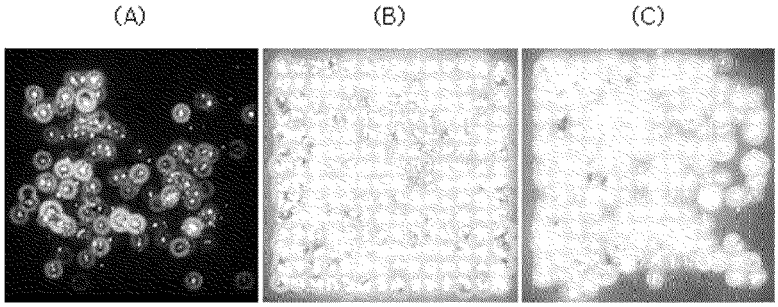
FIGS. 5(A)-5(C) are electron emission images of a field electron emitter prepared by an exemplary embodiment of a method of preparing a carbon nanotube field electron emitter according to the present invention.

The lower plate 202 includes the lower substrate 110 facing the upper substrate and spaced apart from the upper substrate 190 to define an internal space therebetween, e.g., an emissive space 210. In addition, the lower substrate 110 is disposed substantially parallel to the upper substrate 190 and includes a cathode 120 disposed on thereon in a stripe pattern, for example, and a gate electrode 140 disposed in a stripe pattern to extend in a direction substantially perpendicular to the cathode 120. The lower substrate 110 further includes an insulating layer 130 disposed between the gate electrode 140 and the cathode 120, a field emission hole 169 formed in a portion of the insulating layer 130 and a portion of the gate electrode 140, and a field emitter 160 disposed in the field emission hole 169 and electrically connected to the cathode 120. As shown in FIG. 5, the field emitter 160 does not reach the gate electrode 140. The field emitter 160 is substantially the same as the exemplary embodiments of the field emitter described in further detail above, and any repetitive detailed description thereof has hereinafter been omitted.

A vacuum, e.g., a pressure less than atmospheric pressure, is maintained in the emissive space 210 between the upper plate 201 and the lower plate 202. A spacer 192 is disposed between the upper plate 201 and the lower plate 202 to maintain a pressure difference therebetween (generated by the vacuum) and to divide the emissive space 210.

In operation, a high voltage is applied to the field electron emission device 200 to accelerate electrons emitted from the field emitter 160 to the anode 180, and the electrons thereby collide with the phosphor layer 170 at high speed. As a result, phosphor in the phosphor layer 170 escapes, and emits visible light when an energy level of the phosphor drops from a high energy level to a lower energy level.

The gate electrode 140 substantially improves an ability of the field emitter 160 to emit the electrons. The insulating layer 130 divides areas between the field emission holes 169, and insulates the field emitter 160 from the gate electrode 140.

The field electron emission device 200 according to the exemplary embodiment shown in FIG. 2 is a triode-type electron emission device 200, but alternative exemplary embodiments are not limited thereto. Rather, an alternative exemplary embodiment of a field electron emission device 200 may include another type of electron emission device 200, such as a diode-type electron emission device 200, for example. In another alternative exemplary embodiment of the field electron emission device 200, the gate electrode 140 may be disposed below the 120 cathode. In addition, the field electron emission device 200 according to an alternative exemplary embodiment may include a grid, e.g., a mesh (not shown), for effectively preventing the gate electrode 140 and/or the cathode 120 from being damaged due to arcing that occurs due to a discharge, for example, and for ensuring that a high concentration of electrons are emitted from the field emitter 160. In yet another exemplary embodiment, the field electron emission device 200 may be used as a displaying device or a backlight unit, for example, but alternative exemplary embodiments are not limited thereto.

Exemplary embodiments will now be described in further detail with reference to examples thereof. However, the examples herein are not intended to limit the purpose and/or scope of alternative exemplary embodiments.

In Example 1, a field electron emitter of carbon nanotube-nucleic acid composite is prepared. More specifically, for Example 1, an aqueous solution including a carbon nanotube-nucleic acid composite is prepared by mixing CNTs and nucleic acid in an aqueous solution. Single walled carbon nanotubes ("SWCNTs") (available from Carbolex) with diameters from about 1.2 nanometers (nm) to about 1.5 nm and lengths from about 2 micrometers (μm) to about 5 μm are used as the CNTs. Total RNA (available from Takar) derived from *saccharomyces ceverisiae* yeast is used as the nucleic acid. More particularly, the total RNA includes ribosomal RNA ("rRNA"), tRNA and messenger RNA ("mRNA"). The tRNA has a length from about 73 base pairs (bp) to about 93 bp, e.g., from about 26 nm to about 33 nm, which is less than the lengths of the CNTs. When the CNTs and the nucleic acid are mixed, the nucleic acid is heated for 15 minutes at 65° C. The nucleic acid is heated to remove a secondary structure of the nucleic acid and to bind the nucleic acid, without the secondary structure, to the CNTs. The CNTs are dispersed by ultrasonicating the CNTs using a pole ultrasonic processor (UP400s, Heilsher) in an aqueous solution for 6 hours at 150 watts (W). Then, the carbon nanotube-nucleic acid composite is dispersed in an aqueous solution by mixing a heated nucleic acid aqueous solution with a carbon nanotube aqueous solution, adding a tris-acetic acid-ethylenediaminetetraacetic acid ("EDTA") ("TAE") buffer to the mixture to have a pH of 8.0, and then ultrasonically processing the resultant by an ultrasonic processor (MXB6, Grant company, UK) for 4 hours at 4° C. and 100 W. The TAE buffer includes tris with a concentration from about 4 mM to about 20 mM, acetic acid with a concentration of about 1.8 mM to about 9 mM, and EDTA with a concentration of about 1 mM to about 5 mM.

A solution in which the carbon nanotube-nucleic acid composite is dispersed is prepared by centrifuging a solution including the carbon nanotube-nucleic acid composite ultrasonically processed at a speed of about 2,000 rotations/revolutions per minute (rpm) to about 4,000 rpm to remove precipitation of the solution including the carbon nanotube-nucleic acid composite.

Then, the solution in which the carbon nanotube-nucleic acid composite is dispersed is put in a glass container, a positive power source is connected to an ITO electrode coated on a substrate including a patterned photoresist layer, a −negative power source is connected to a counter electrode, e.g., a platinum (Pt) electrode facing the substrate, and then an AC voltage is applied to the ITO electrode and the Pt electrode. A distance between the ITO electrode and the Pt electrode from about 0.5 cm to about 2 cm. An AC voltage from about 8 V to about 40V is applied for about 0.5 minutes to about 8 minutes.

An exemplary embodiment of a method of forming a photoresist pattern on the substrate will now be described. First, the ITO electrode is prepared by coating ITO on a glass substrate using a sputtering coating method to form an ITO layer with a thickness of 200 nm. A photoresist layer with a thickness of about 1.2 μm is prepared by coating photoresist (AZ1512, Clariant) on the ITO layer using a spin coating method. Then, 365 (l-line) nm light is irradiated onto the photoresist layer via a mask, and an irradiated portion of the photoresist layer is developed by an acetone developer. As a result, an array of dots is formed on the glass substrate, each dot having a square shape with sides of 9.3 cm, a diameter of 400 millimeters (mm), and a distance between the dots of 300 mm. An array of carbon nanotube-nucleic acid is prepared by depositing the carbon nanotube-nucleic acid on the array of dots on the substrate by applying the AC voltage of about 8 V to about 40 V.

A portion of the photoresist which is not patterned is removed by acetone. The substrate on which the portion of the photoresist is removed is dried for 30 minutes at 90° C., and is then heated for 30 minutes at 400° C. In a control sample, the substrate was not heated at 400° C. Thereafter, it is confirmed, after removing the portion of photoresist and taking and examining a transmission electron microscopy ("TEM") photograph of the surface of the substrate and a cross-section thereof, that a uniform array of carbon nanotube-nucleic acid is immobilized on the surface of the substrate.

The carbon nanotube field electron emitter is activated by attaching an adhesive tape formed of polypropylene to the heated substrate and then detaching the adhesive tape from the heated substrate. In a control sample, the above taping operation was not performed.

In Example 2, an influence of taping (for activating a carbon nanotube field electron emitter) is checked. More particularly, in Example 2, it is determined how taping influences electron emission properties of the field electron emitter prepared according to Example 1. Thus, a field electron emitter according to Example 1, on which taping was performed, and a field electron emitter on which the taping was not performed were prepared. Specifically, an anode coated by green phosphor (ZnS:Cu, Al) is spaced apart from each of two field electron emitters by an interval of 240 μm, and a voltage is applied between an anode and each the field electron emitters. Then, electrons emitted from each of the field electron emitters and are measured as a current. Alternatively, an image of a phosphor emitted from the field electron emitters is taken by a digital camera.

Figure 3:
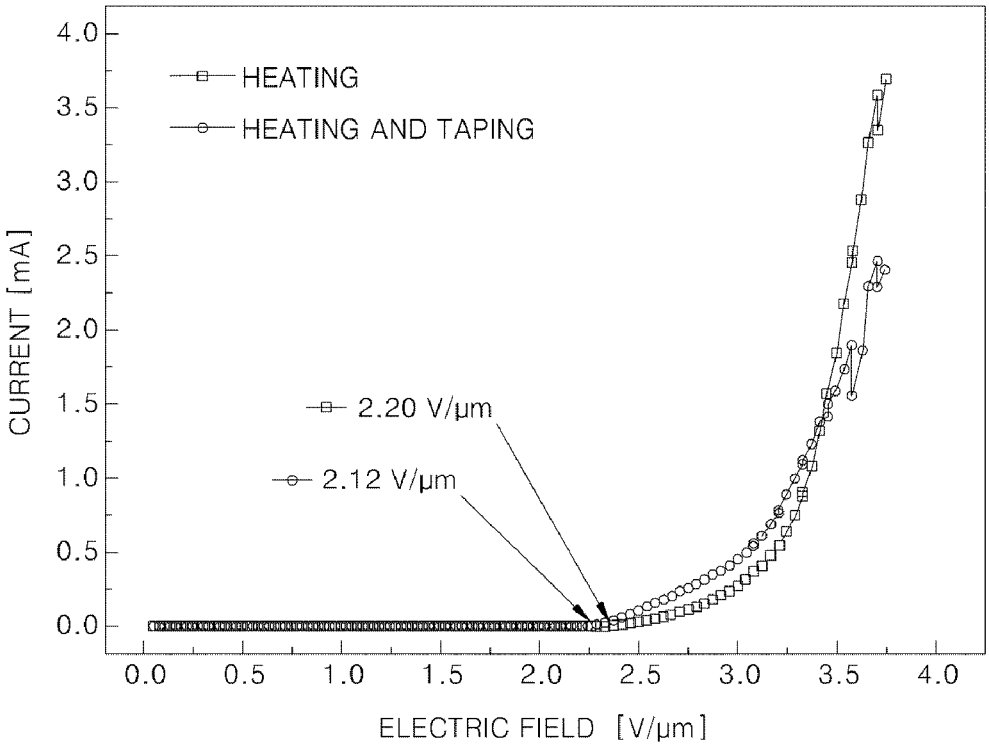
FIG. 3 is a graph of current versus electric field strength illustrating differences in field electron emission properties of a carbon nanotube field electron emitter prepared using a method in which only heating is performed carbon nanotube field electron emitter prepared using a method in which both heating and taping are performed.

FIG. 3 is a graph of current, in milliamps (mA), versus electric field strength, in volts per micrometer (V/μm), illustrating differences in field electron emission properties of a carbon nanotube field electron emitter prepared using a method in which only heating is performed carbon nanotube field electron emitter prepared using a method in which both heating and taping are performed. Referring to FIG. 3, there is no significant difference between the abovementioned two cases. Thus, in alternative exemplary embodiments, methods of preparing a carbon nanotube field electron emitter may or may not include activating a field electron emitter by performing a surface-treatment such as taping, for example. In FIG. 2, 2.20 V/μm and 2.12 V/μm refer to threshold values for the abovementioned two cases.

Figure 4:
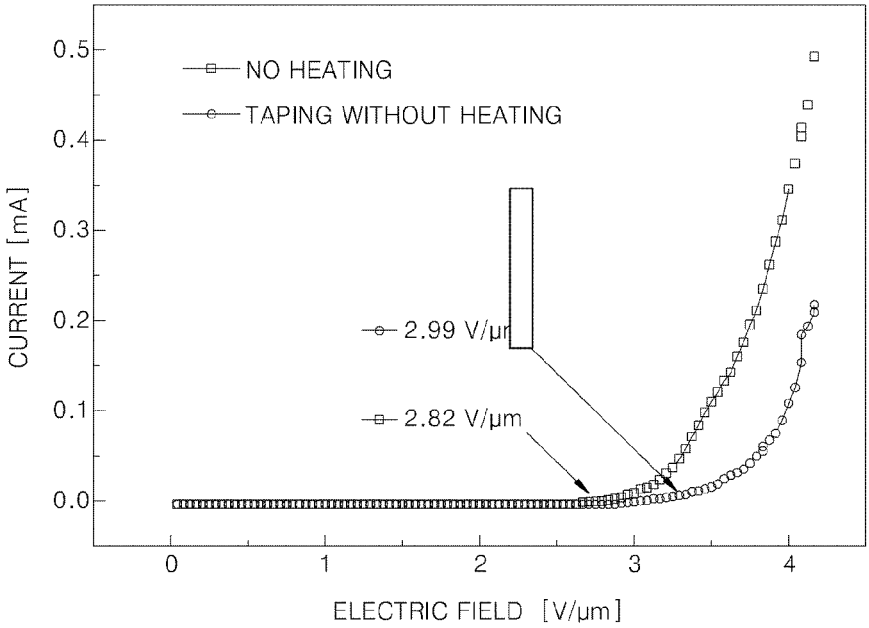
FIG. 4 is a graph of current versus electric field strength illustrating differences in field electron emission properties of a carbon nanotube field electron emitter prepared using a method in which heating is not performed and a carbon nanotube field electron emitter prepared using a method in which heating is not performed and taping is performed.

FIG. 4 is a graph of current versus electric field strength illustrating differences in field electron emission properties of a carbon nanotube field electron emitter prepared using a method in which heating is not performed and a carbon nanotube field electron emitter prepared using a method in which heating is not performed and taping is performed. Referring to FIG. 4, when taping is performed, the field electron emission properties are not substantially improved as compared to a case in which taping is not performed. In FIG. 4, 2.82 V/μm and 2.99 V/μm refer to threshold values in the abovementioned two cases.

FIGS. 5(A)-5(C) are electron emission images of a field electron emitter prepared by an exemplary embodiment of a method of preparing a carbon nanotube field electron emitter. Specifically, FIG. 5(A) is a phosphor emission image of a case in which 1100 V (4.58 V/μm, and 1.17 mA) is applied after performing deposition and removing a photoresist. FIG. 4(B) is a phosphor emission image of a case in which 900 V (3.75 V/μm, and 2.25 mA) is applied after removing a photoresist and performing heating for 30 minutes at 400° C. in a nitrogen atmosphere. Thus, FIG. 5(B) illustrates a case wherein taping is not performed as an activation method. From FIG. 5(B), it can be seen that uniform field electron emission effects are obtained without performing taping. FIG. 5(C) is a phosphor emission image of a case in which 900 V (3.75 V/μm, and 2 mA) is applied after removing a photoresist, and heating is performed for 30 minutes at 400° C. in a nitrogen atmosphere, and taping is performed. As shown in FIG. 5(C), it may be seen that a portion of a field electron emitter is removed by performing the taping to generate a region from which electrons are not emitted.

Another example of an exemplary embodiment will now be described in further detail. Specifically, in Example 3 and influence of different kinds of nucleic acid and buffer on electron emission properties of a carbon nanotube field electron emitter are compared. More specifically, in Example 3, it is determined how various kinds of nucleic acid and buffer influenced electron emission properties of a field electron emitter according to an exemplary embodiment.

Compositions of nucleic acids and buffers used in Example 3 are shown in Table 1.

TABLE 1

| Sample | distilled water (ml) | SWCNT (mg) | RNA(mg) | TAE buffer | | | additive |
|---|---|---|---|---|---|---|---|
| | | | tris | | EDTA | acetic acid | |
| 1 | 200 | 40 | 40(total RNA) | — | — | — | — |
| 2 | 200 | 40 | 40(total RNA) | 4 mM | 1.0 mM | 1.8 mM | — |
| 3 | 200 | 40 | 40(total RNA) | 20 mM | 5.0 mM | 9 mM | — |
| 4 | 200 | 40 | 40(total RNA) | 40 mM | 10 mM | 1.8 mM | — |
| 5 | 200 | 40 | 10(t-RNA) | 4 mM | 1.0 mM | 1.8 mM | — |
| 6 | 200 | 20 | 10(t-RNA) | 4 mM | 1.0 mM | 1.8 mM | — |
| 7 | 200 | 20 | 10(t-RNA) | 4 mM | 1.0 mM | 1.8 mM | 1% SDS |
| 8 | 200 | 80 | 16(t-RNA) | 4 mM | 1.0 mM | 1.8 mM | — |

In Table 1, tris indicates tris(2-amino-2-(hydroxymethyl)-1,3-propandiol, t-RNA indicates transfer RNA and EDTA indicates ethylenediaminetetraacetic acid.

For Example 3, the compositions of Table 1 are used, and a degree of deposition of carbon nanotube-nucleic acid composite is measured. The carbon nanotube-nucleic acid composite is deposited in Samples 1 to 7. In Samples 1 to 7, Sample 5 exhibits the most uniform deposition, as shown in Table 1. In Sample 7, a time taken to perform deposition is longer than a case where sodium dodecyl sulfate ("SDS") is not used.

Thus, with regard to nucleic acids, when tRNA is used, electron emission properties of a field electron emitter are substantially improved as compared to a case where total RNA is used. In addition, when a TAE buffer is used, a field electron emitter having substantially improved field emission properties is prepared without requiring a surfactant such as SDS.

As described herein, a carbon nanotube field electron emitter according to an exemplary embodiment provides substantially improved electron emission properties. Moreover an exemplary embodiment of a method of preparing the carbon nanotube field electron emitter is substantially improved, e.g., is substantially simplified.

In addition, an exemplary embodiment provides a field electron emission device having substantially improved electron emission properties, e.g., substantially uniform emission properties.

The present invention should not be construed as being limited to the exemplary embodiments set forth herein. Rather, these exemplary embodiments are provided so that this disclosure will be thorough and complete and will fully convey the concept of the present invention to those skilled in the art.

While the present invention has been particularly shown and described with reference to exemplary embodiments thereof, it will be understood that the exemplary embodiments described therein should be considered in a descriptive sense only and not for purposes of limitation. In addition, it will be understood by those of ordinary skill in the art that various changes in form and details may be made therein without departing from the spirit or scope of the present invention as defined by the following claims.

What is claimed is:

1. A method of preparing a carbon nanotube field electron emitter, the method comprising:

preparing an aqueous solution comprising a carbon nanotube-nucleic acid composite;

preparing a substrate to receive the carbon nanotube-nucleic acid composite; and electrophoresis-depositing the carbon nanotube-nucleic acid composite onto the substrate.

2. The method of claim 1, wherein the carbon nanotube-nucleic acid composite comprises a nucleic acid including one selected from a group consisting of deoxyribonucleic acid, ribonucleic acid and peptide nucleic acid.

3. The method of claim 1, wherein the carbon nanotube-nucleic acid composite comprises a nucleic acid including one selected from a group consisting of a single-stranded nucleic acid and a double-stranded nucleic acid.

4. The method of claim 1, wherein the aqueous solution comprising the carbon nanotube-nucleic acid composite further comprises one selected from a group consisting of water, a tris-acetic acid-ethylenediaminetetraacetic acid buffer solution and any mixtures thereof.

5. The method of claim 1, wherein the preparing the aqueous solution comprising the carbon nanotube-nucleic acid composite comprises:

mixing carbon nanotubes and nucleic acid in an aqueous solution; and removing a precipitation from the aqueous solution.

6. The method of claim 5, wherein the preparing the aqueous solution comprising the carbon nanotube-nucleic acid composite further comprises sonicating the aqueous solution of the carbon nanotubes mixed with the nucleic acid.

7. The method of claim 5, wherein the removing the precipitation comprises performing centrifugation of the aqueous solution.

8. The method of claim 5, wherein the carbon nanotubes and the nucleic acid are mixed in a ratio, based on weight, from about 1:1 to about 4:1.

9. The method of claim 1, wherein the substrate comprises a patterned photoresist layer.

10. The method of claim 9, further comprising:

electrophoresis-depositing the carbon nanotube-nucleic acid composite onto a region of the substrate patterned by the patterned photoresist layer; and removing the photoresist from the substrate.

11. The method of claim 1, further comprising at least one of sintering the substrate comprising the carbon nanotube-nucleic acid composite and activating the substrate comprising the carbon nanotube-nucleic acid composite.

12. The method of claim 11, wherein the sintering the substrate comprising the carbon nanotube-nucleic acid composite comprises heating the substrate at a temperature from about 200 degrees Celsius to about 500 degrees Celsius.

13. The method of claim 11, wherein the activating the substrate comprising the carbon nanotube-nucleic acid composite comprises taping.

14. The method of claim 1, wherein the electrophoresis-depositing the carbon nanotube-nucleic acid composite onto the substrate is performed at a voltage from about 5 volts to about 15 volts.

* * * * *